US006295693B1

(12) United States Patent
Chou

(10) Patent No.: US 6,295,693 B1
(45) Date of Patent: Oct. 2, 2001

(54) AIR COMPRESSOR HAVING ATTACHABLE AND DETACHABLE NOZZLE

(76) Inventor: Wen San Chou, No. 1-25, Kang Wei Village, An Din Hsiang, Tainan Hsien (TW), 745

( * ) Notice: Subject to any disclaimer, the term of this patent is extended or adjusted under 35 U.S.C. 154(b) by 0 days.

(21) Appl. No.: 09/617,769

(22) Filed: Jul. 17, 2000

(51) Int. Cl.[7] ..... A47L 5/14

(52) U.S. Cl. ..... 15/330; 15/339; 15/414; 15/415.1; 141/66

(58) Field of Search ..... 15/330, 414, 415.1, 15/339; 141/66

(56) References Cited

U.S. PATENT DOCUMENTS 2,920,337 * 1/1960 Smith ..... 15/330 X
3,238,556 * 3/1966 Martin ..... 15/330
4,114,230 * 9/1978 MacFarland ..... 15/415.1 X
4,405,158 * 9/1983 Huberman ..... 15/415.1 X
4,636,230 * 1/1987 Fan ..... 15/339 X
4,999,036 3/1991 Hwang et al. .
5,105,504 * 4/1992 Brzoska ..... 15/330
5,938,410 * 8/1999 Lee ..... 15/330 X
5,947,168 * 9/1999 Viard ..... 141/66 X

* cited by examiner

*Primary Examiner*—Chris K. Moore
(74) *Attorney, Agent, or Firm*—Charles E. Baxley

(57) ABSTRACT

An air compressor includes a housing having an air outlet for selectively supplying a pressurized air to an air device, and having a port for coupling to the air device and for drawing the air out of the air device, and having an air inlet for allowing the air to flow into the housing. One or more nozzles each may be selectively and detachably secured to either of the air outlet and the port of the housing for coupling to various kinds of air devices. The air inlet may be selectively blocked for facilitating the drawing of the air into the housing via the port.

13 Claims, 10 Drawing Sheets

AIR COMPRESSOR HAVING ATTACHABLE AND DETACHABLE NOZZLE

BACKGROUND OF THE INVENTION

1. Field of the Invention

The present invention relates to an air compressor, and more particularly to an air compressor having one or more nozzles that may be easily attached to or detached from the air compressor for various kinds of uses.

2. Description of the Prior Art

Typical air compressors comprise a fan rotatably received in a housing and driven by a motor for drawing air into the housing and for generating a pressurized air to inflate the tires, air beds or air cushions, hovercrafts, etc. One of the typical air compressors is disclosed in U.S. Pat. No. 4,999,036 to Hwang et al., and comprise an air inlet for allowing the air to flow into the housing, and an air outlet for supplying the pressurized air to the air devices that are required to be inflated. The typical air compressors may not be used to discharge or to release the air in the air devices. In addition, the typical air compressors have no various kinds of nozzles for engaging with the various kinds of air devices.

The present invention has arisen to mitigate and/or obviate the afore-described disadvantages of the conventional air compressors.

SUMMARY OF THE INVENTION

The primary objective of the present invention is to provide an air compressor including one or more nozzles for selectively attached to the air compressor and to selectively couple the air compressor to various kinds of air devices for inflating the air devices.

The other objective of the present invention is to provide an air compressor including one or more nozzles for selectively attached to the air compressor and for discharging or releasing the air from the air devices.

In accordance with one aspect of the invention, there is provided an air compressor comprising a housing including an air outlet provided therein for coupling to an air device and for supplying an air to the air device, a port provided therein for coupling to the air device and for drawing the air out of the air device, and an air inlet provided therein for inwardly flowing of the air into the housing, a first nozzle, and securing means for detachably securing the first nozzle to either of the air outlet and the port of the housing.

The air outlet includes a peripheral wall, a spider rib disposed in the peripheral wall for defining a plurality of apertures and for the air to flow out of the housing. The securing means includes a pair of ears extended inward of the peripheral wall of the air outlet, and a pair of latches extended from the first nozzle for engaging with the ears and for securing the first nozzle to the air outlet. The spider rib is spaced from the ears for defining a channel between the ears and the spider rib and for receiving the latches of the first nozzle.

The port includes a peripheral wall, a spider rib disposed in the peripheral wall for defining a plurality of apertures and for the air to flow into the housing. The securing means includes a pair of ears extended inward of the peripheral wall of the port, and a pair of latches extended from the first nozzle for engaging with the ears and for securing the first nozzle to the port. The spider rib is spaced from the ears for defining a channel between the ears and the spider rib and for receiving the latches of the first nozzle.

A blocking device is further provided for selectively blocking the air inlet and includes a cover for selectively engaged with the air inlet and for selectively blocking the air inlet. The air inlet includes a protrusion extended therefrom, the cover includes an orifice formed therein for receiving the protrusion of the air inlet and for blocking the air inlet.

The air inlet includes at least one hole formed therein for inwardly flowing of the air into the housing, the cover is selectively engaged with the air inlet to selectively block the air inlet. The air inlet includes a peripheral wall provided therein, and limiting means for limiting a relative movement between the cover and the peripheral wall of the air inlet. The limiting means includes a peripheral flange extended radially outward of the peripheral wall of the air inlet, and a peripheral rib extended radially inward of the cover and engaged with the peripheral flange of the peripheral wall for limiting the relative movement between the cover and the peripheral wall of the air inlet.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
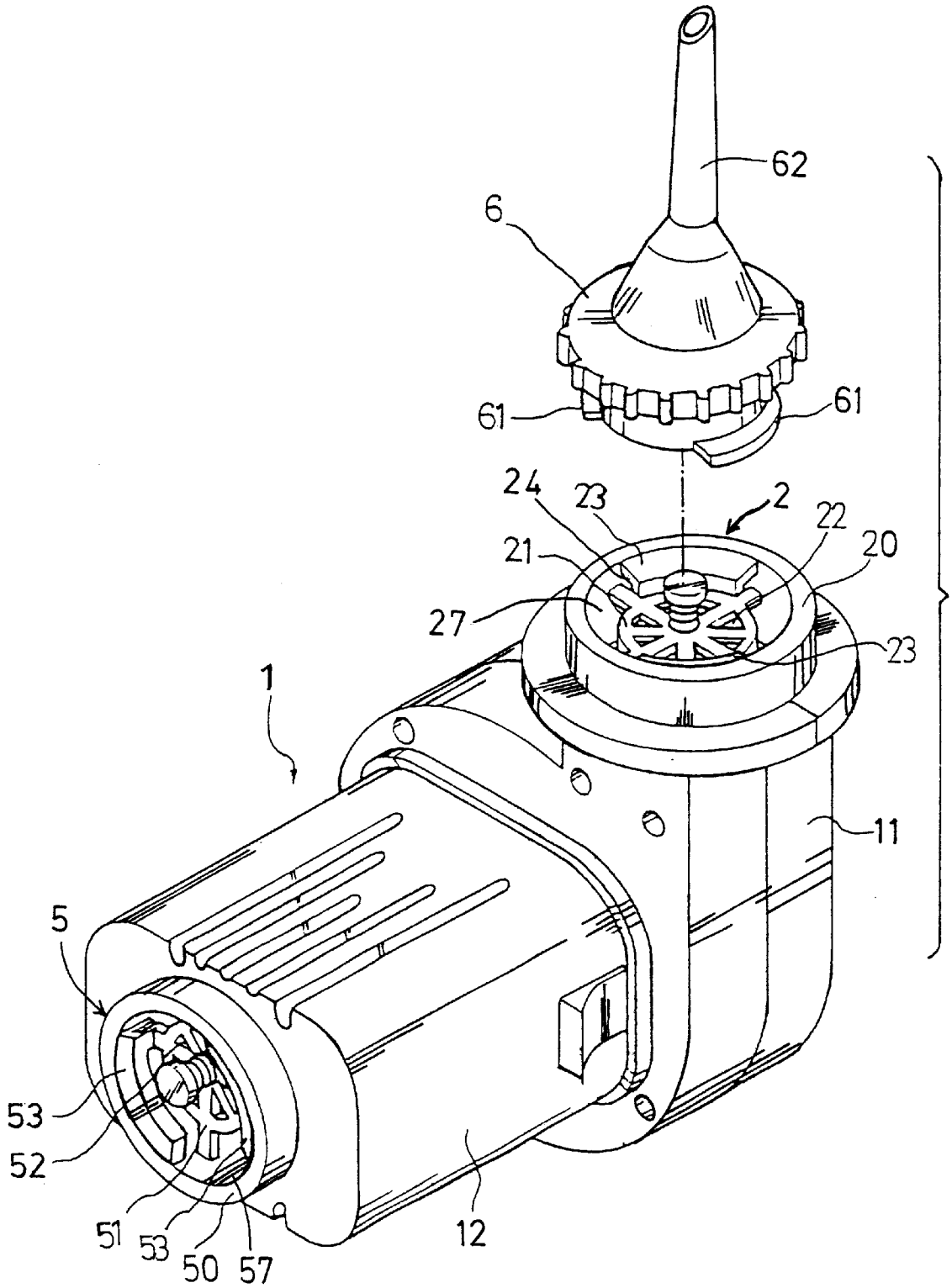
FIGS. 1, 2, 3 are partial exploded views illustrating an air compressor in accordance with the present invention, having one or more nozzles for selectively attaching to the air compressor.
Figure 2:
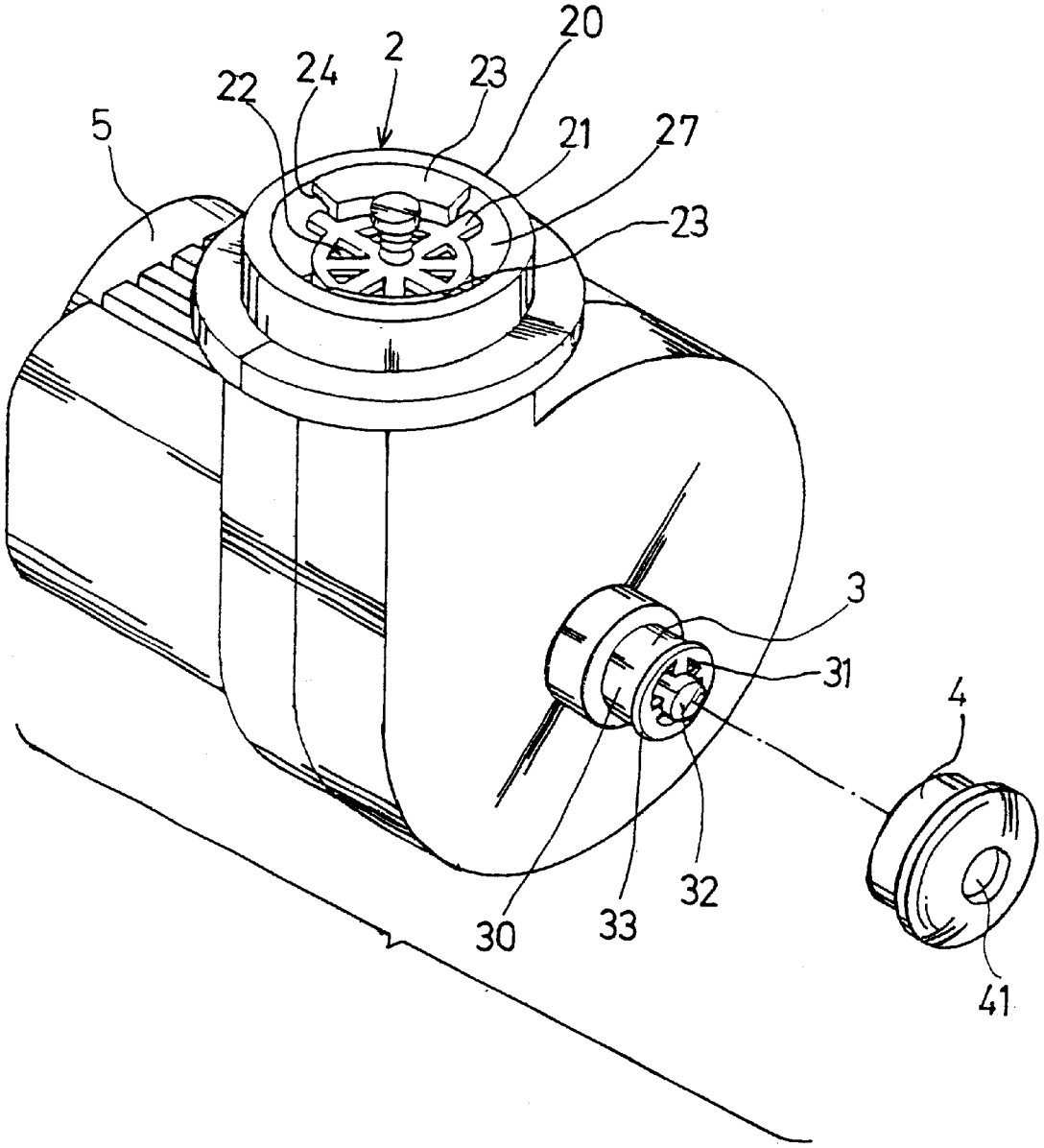
Figure 3:
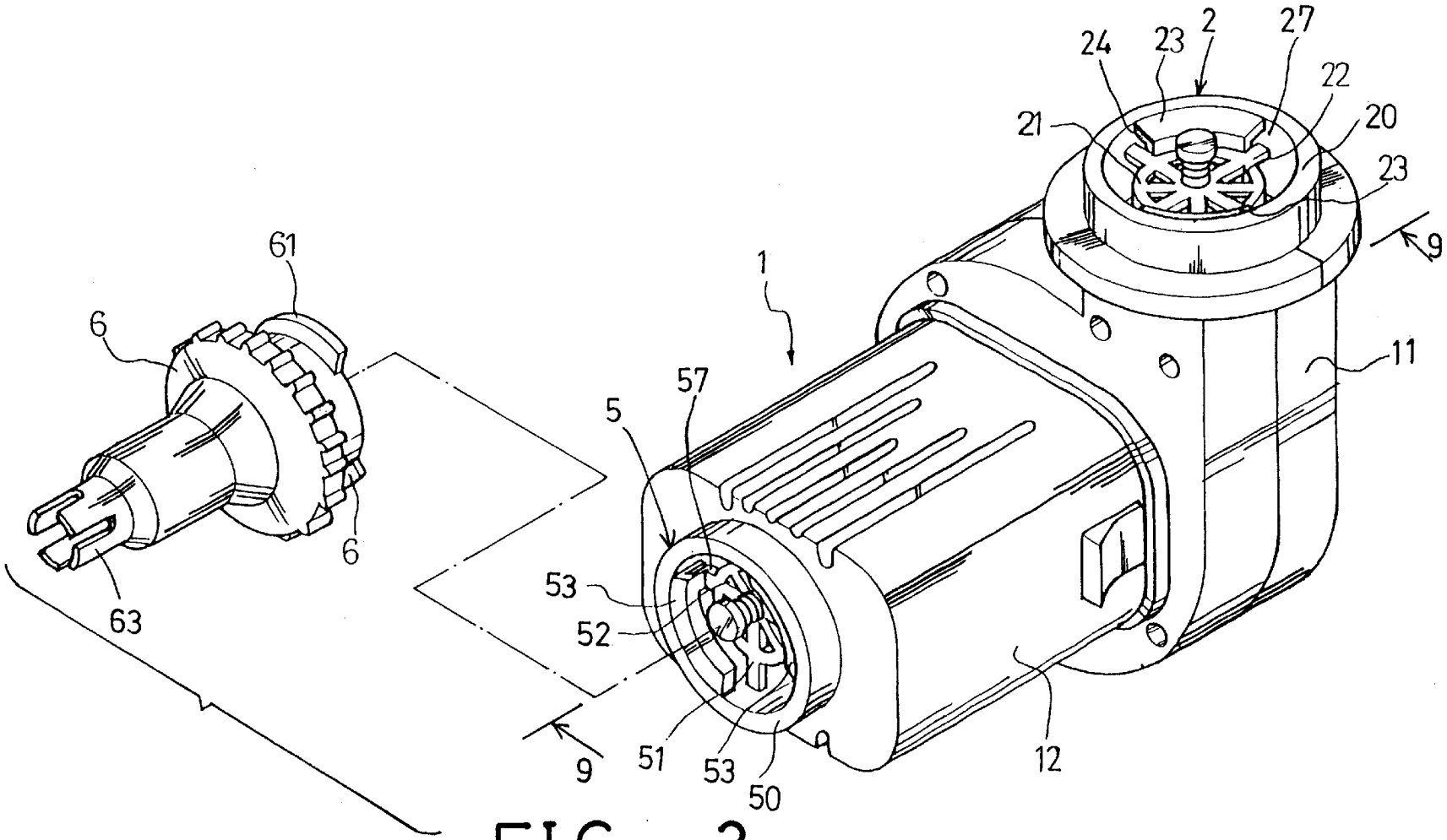
Figure 4:
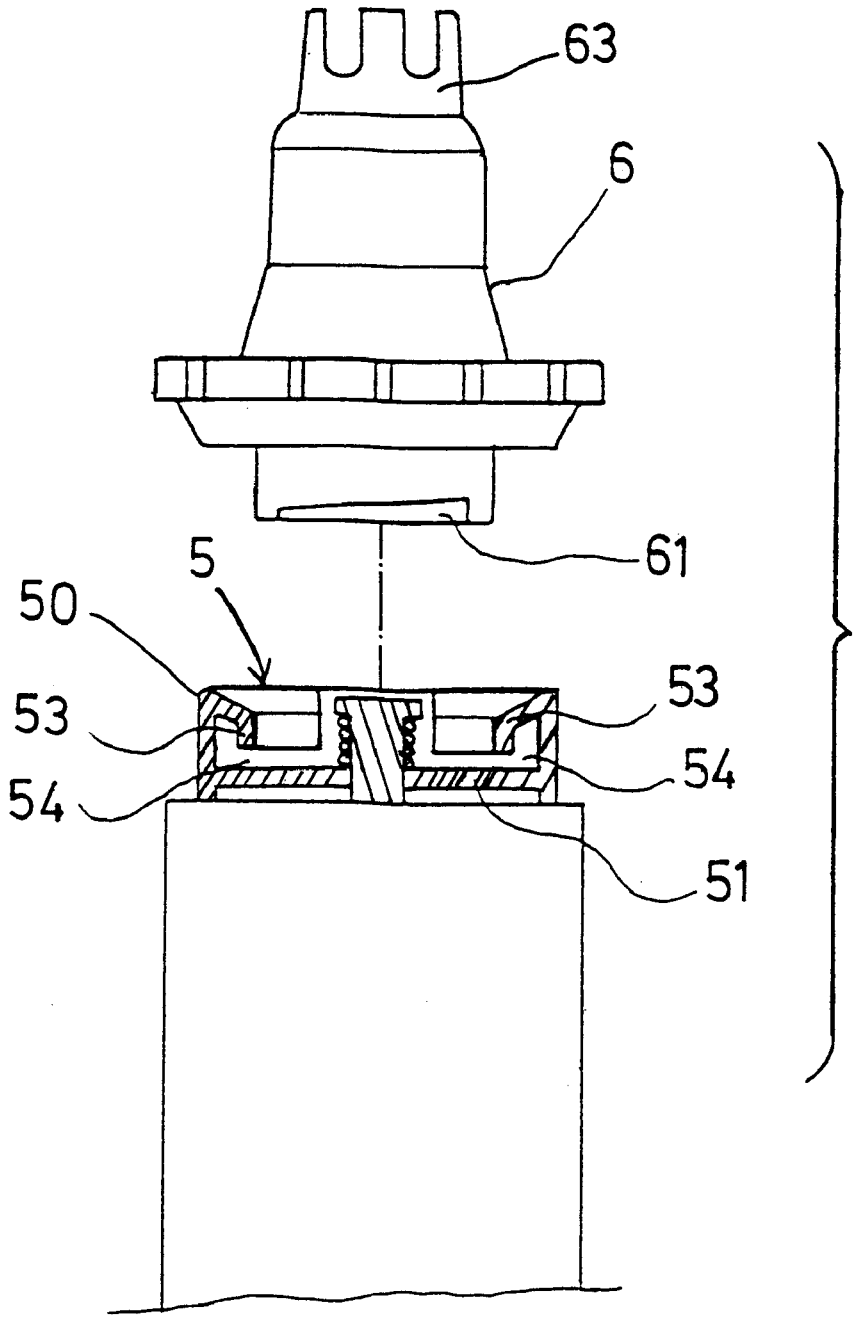
FIG. 4 is a partial exploded and cross sectional view, illustrating one of the nozzles for attaching to the air compressor.

Referring to the drawings, and initially to FIGS. 1–3, an air compressor in accordance with the present invention comprises a housing 1 for receiving the fan device and the motor. The fan device may be powered or driven by the motor for drawing air into the housing 1 and for generating a pressurized air to pump the air devices. One of the arrangements for the fan device and the pump is disclosed in U.S. Pat. No. 4,999,036 to Hwang et al., which is taken as a reference for the present application. The housing 1 may include a fan casing 11 and a motor casing 12, for example, for receiving the fan device and the motor respectively. The housing 10 includes an air inlet 3 for allowing the air to flow into the housing 1, and includes an air outlet 2 for supplying the pressurized air in the housing 1 or generated by the motor driven fan device out to the air devices, and includes a port 5 for coupling to the air devices and for discharging or sucking or releasing the air out of the air devices.

Figure 9:
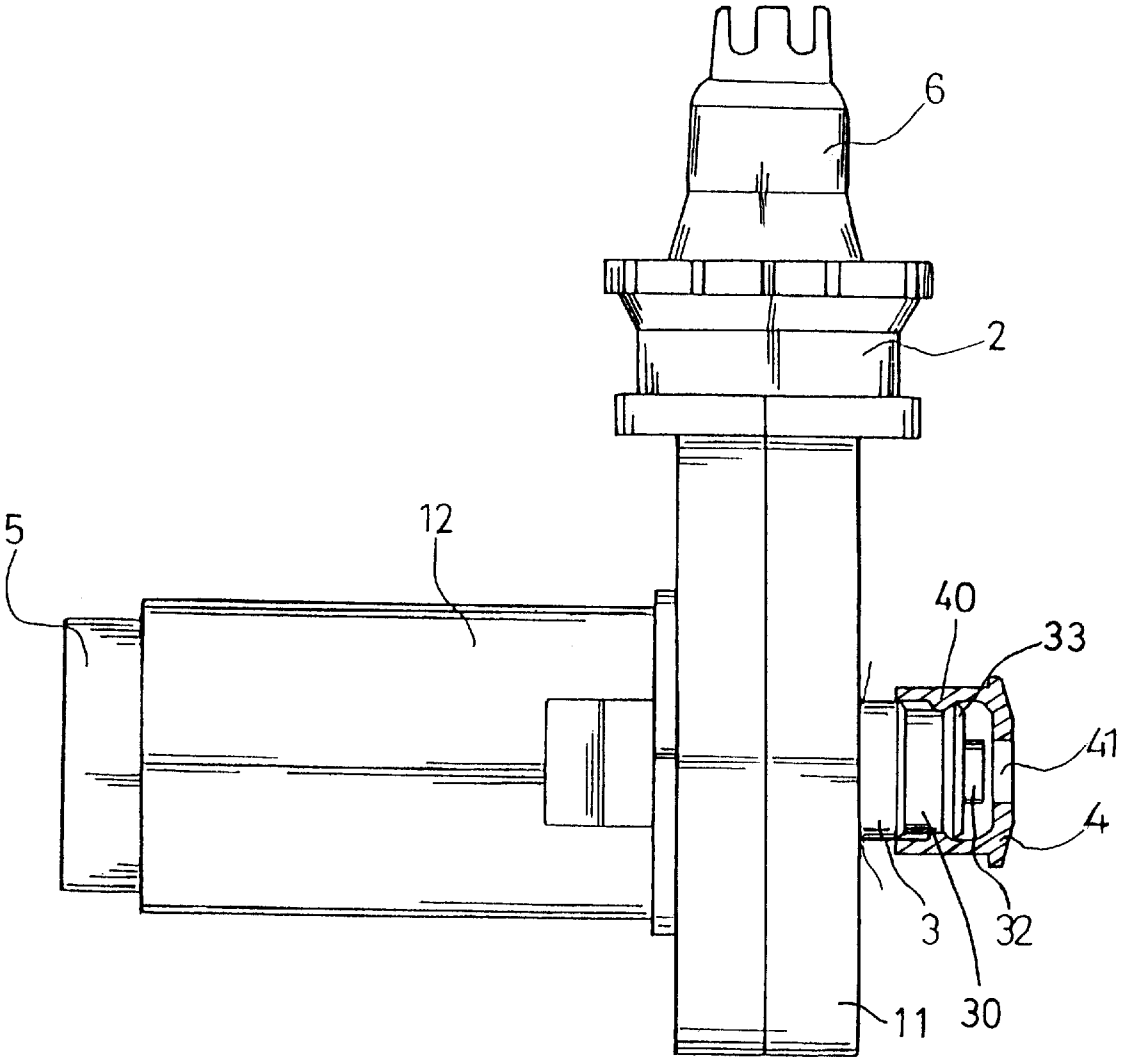
FIG. 9 is a partial cross sectional view taken along lines 9—9 of FIG. 3.
Figure 10:
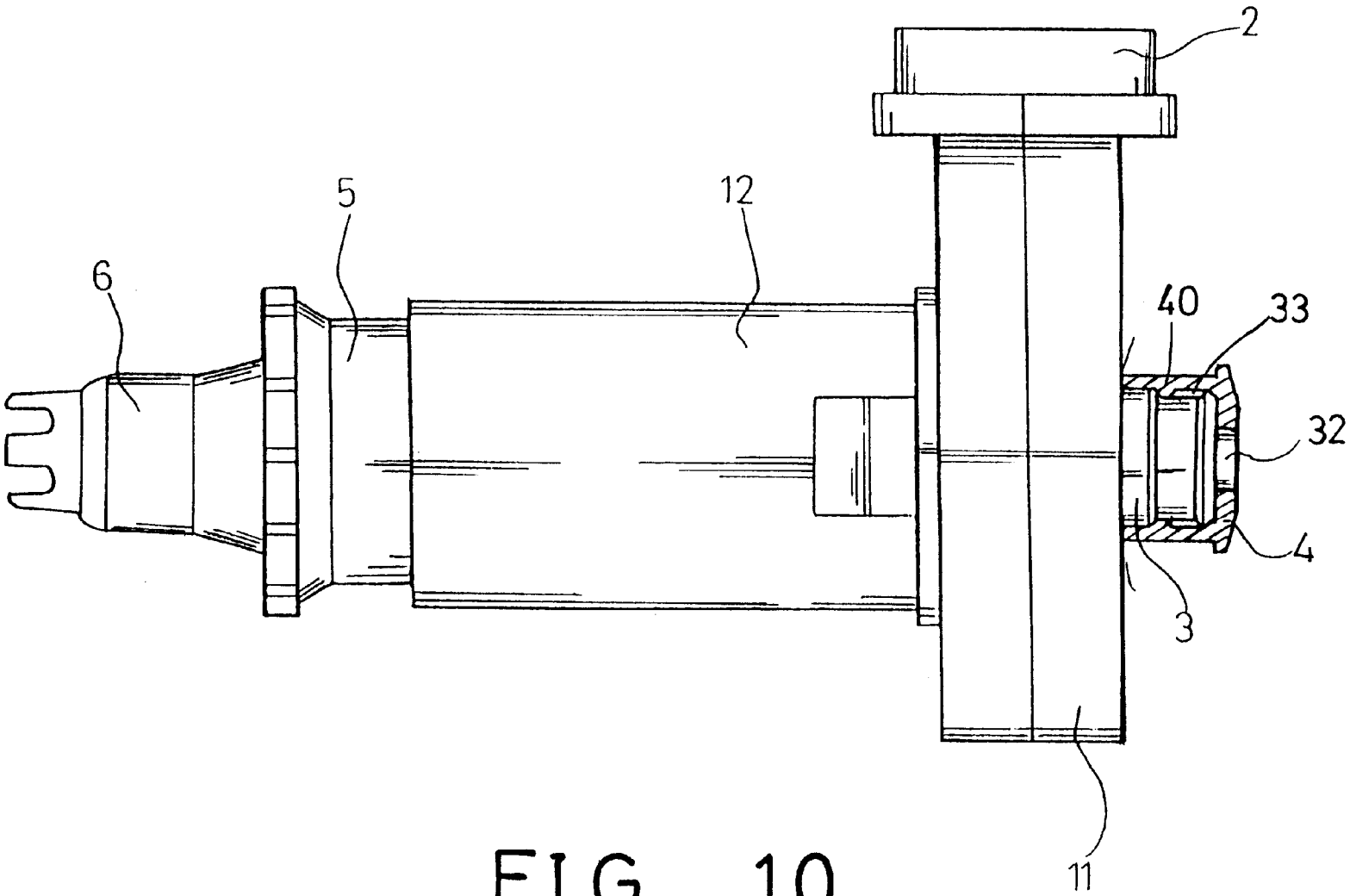
FIG. 10 is a partial cross sectional view similar to FIG. 9, illustrating the operation of one of the nozzles.

Referring particularly to FIGS. 2, 9 and 10, the air inlet 3 includes a peripheral wall 30 having one or more holes 31 formed and provided therein for the air to flow into the housing 1, and includes a protrusion 32 extended outward therefrom, particularly extended outward from the center portion of the peripheral wall 30, and includes a peripheral flange 33 extended radially outward from the free end portion of the peripheral wall 30. The protrusion 32 is further extended outward beyond the peripheral flange 33. A cover 4 is slidably engaged onto the peripheral wall 30 and includes a peripheral rib 40 extended radially inward therefrom for engaging with the peripheral flange 33 of the peripheral wall 30 and for limiting the relative movement between the cover 4 and the peripheral wall 30, and for preventing the cover 4 from being disengaged from the air inlet 3 of the housing 1. The cover 4 includes an orifice 41 formed therein for receiving the protrusion 32 with a force-fitted engagement or with an air tight seal. When the cover 4 is forced toward the peripheral wall 30 to engage the protrusion 32 into the orifice 41 of the cover 4, the holes 31 of the air inlet 3 may be blocked (FIG. 10), such that the air may not flow into the housing 1 via the air inlet 3. As shown in FIG. 9, when the orifice 41 of the cover 4 is disengaged from the protrusion 32, the air is allowed to flow into the housing 1 via the orifice 41 of the cover 4 and the holes 31 of the air inlet 3.

Referring now to FIGS. 1–8, the air outlet 2 and the port 5 of the housing 1 each also includes a cylindrical or peripheral wall 20, 50, and each includes a number of beams or a spider rib 21, 51 laterally provided in the inner portion of the peripheral wall 20, 50 for forming or defining a number of apertures 22, 52 therein and for allowing the air to flow out of and into the housing 1 via the air outlet 2 and the port 5 respectively. The air outlet 2 and the port 5 of the housing 1 each includes one or more, particularly two opposite ears 23, 53 extended radially inward of the respective peripheral wall 20, 50 and spaced from the spider rib 21, 51 for defining a channel 24, 54 between the spider rib 21, 51 and the ears 23, 53 respectively. The ears 23, 53 are spaced from each other and have gaps 27 (FIGS. 1–3), 57 (FIGS. 1, 5, 6) formed between the ears 23, 53.

Figure 5:
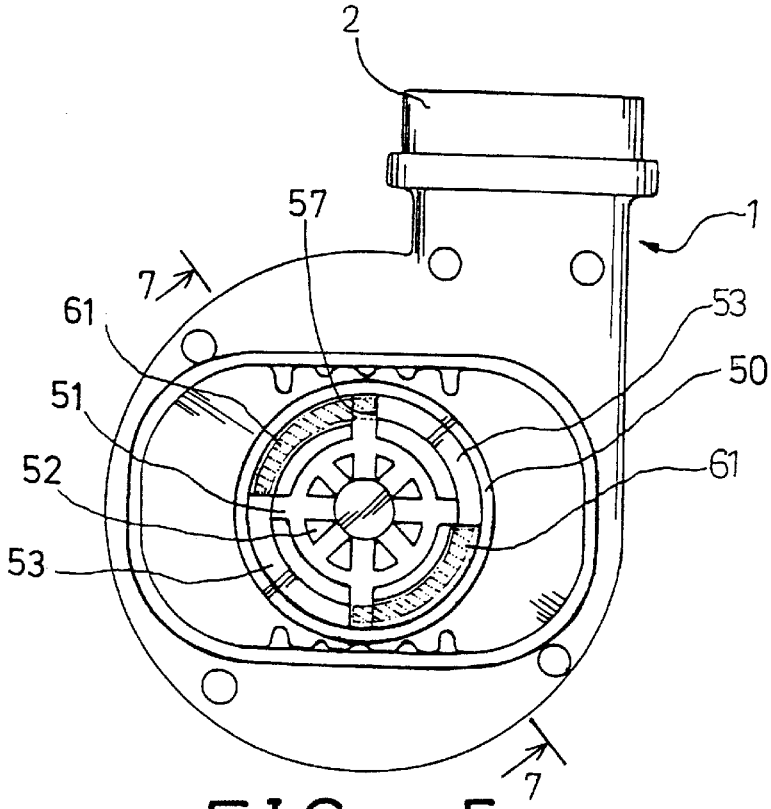
FIGS. 5 and 6 are end schematic views, illustrating the securing of one of the nozzles to the air compressor.
Figure 6:
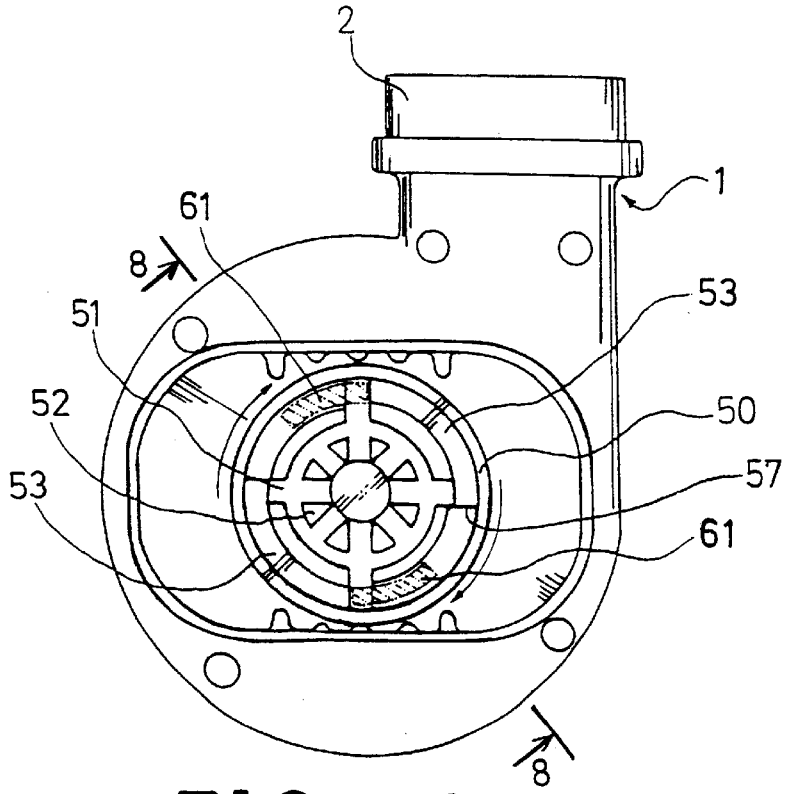
Figure 7:
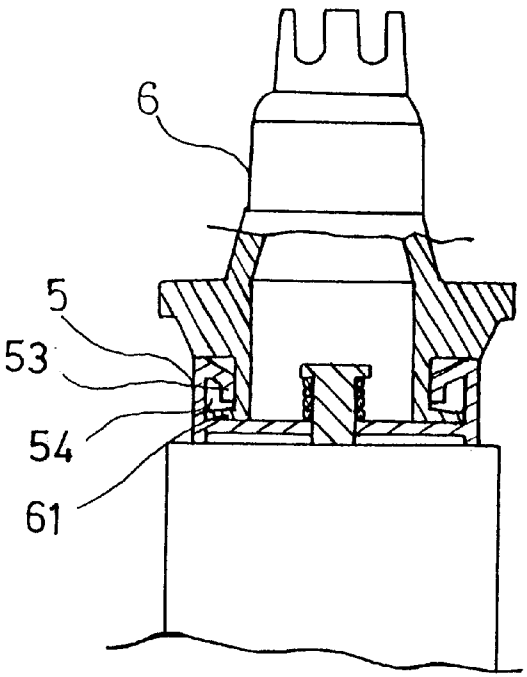
FIGS. 7 and 8 are partial cross sectional views taken along lines 7—7 and 8—8 of FIGS. 5 and 6 respectively.
Figure 8:
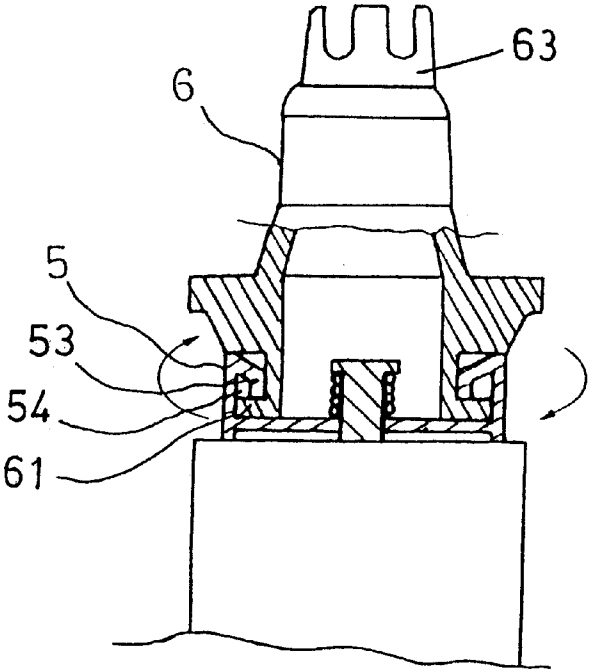
Figure 13:
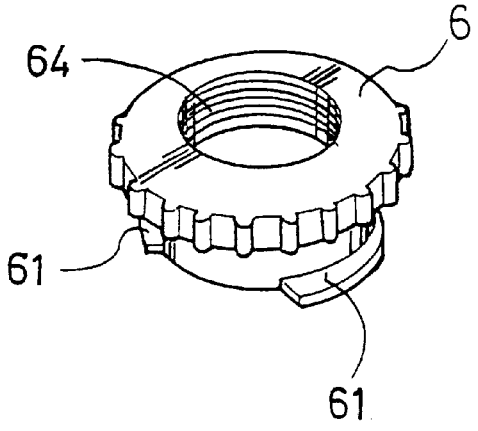
FIG. 13 is a perspective view illustrating the other application of the nozzle for the air compressor.

One or more nozzles 6 each includes one or more, particularly two opposite helical latches 61 extended radially outward therefrom for selectively engaging into the channels 24, 54 of the air outlet 2 and the port 5 via the gaps 27, 57 formed between the ears 23, 53 (FIGS. 5, 6). The nozzles 6 may be rotated relative to the respective peripheral walls 20, 50 for solidly engaging the helical latches 61 with the ears 23, 53 respectively (FIGS. 7, 8) and for selectively and solidly securing the nozzle 6 to the air outlet 2 and the port 5. The nozzles 6 include various kinds of mouths 62, 63 of different sizes or shapes for attaching onto the various kinds of air devices. As shown in FIG. 13, the nozzle 6 may also include a threaded or screw hole 64 formed therein for coupling to the air devices with a threaded coupler or the like.

Figure 11:
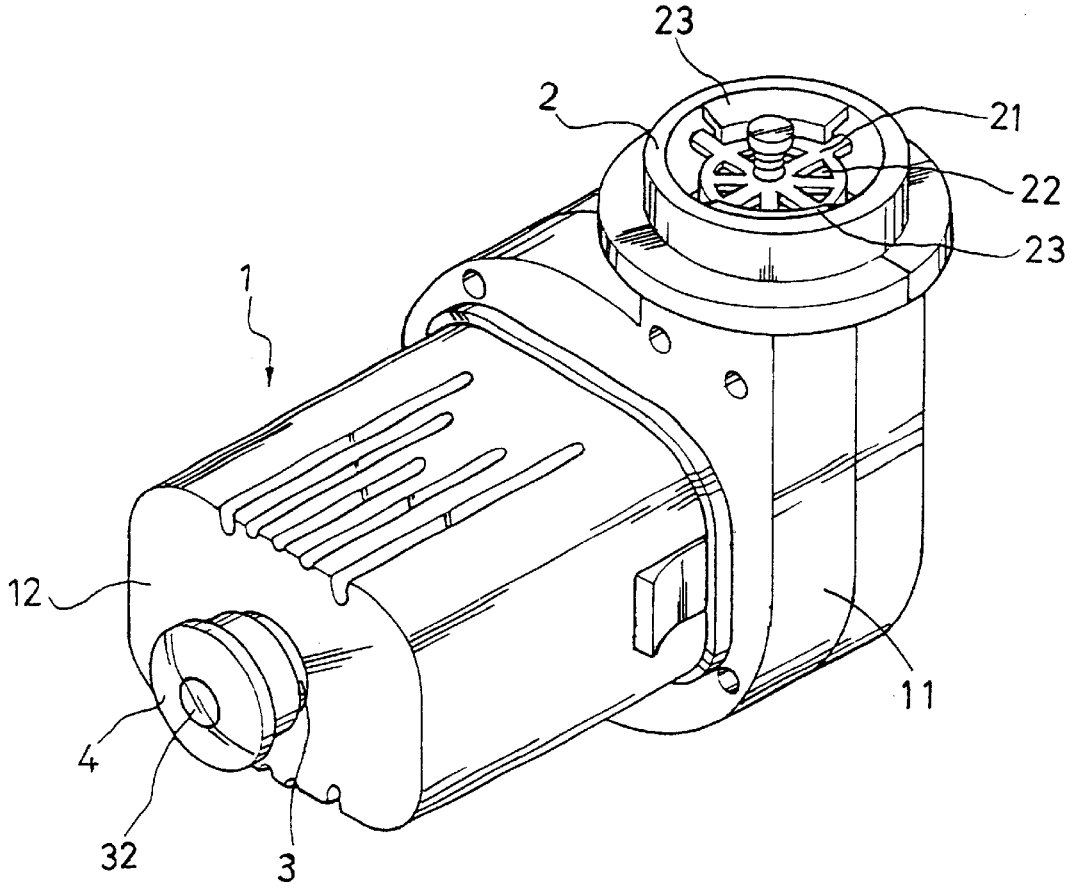
FIG. 11 is a perspective view illustrating the other application of the air compressor.
Figure 12:
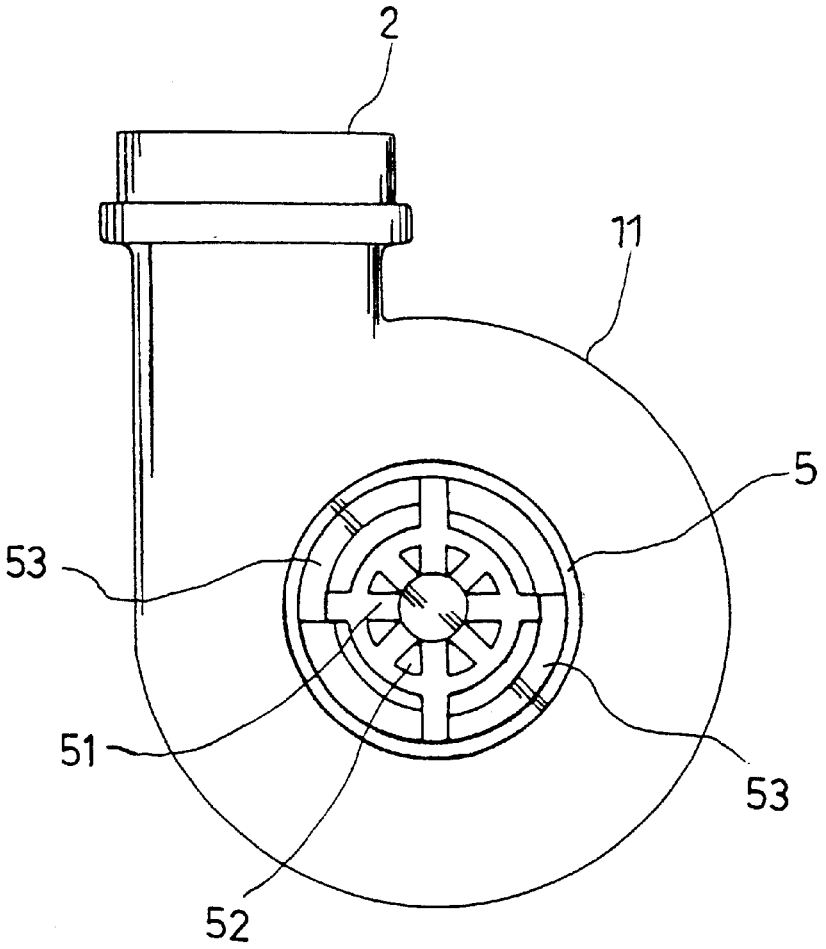
FIG. 12 is an end view of the air compressor as shown in FIG. 11.

Alternatively, as shown in FIGS. 11, 12, the air inlet 3 and the cover 4 may be provided in the motor casing 12 (FIG. 11) instead of being provided in the fan casing 11 (FIGS. 1, 9, 10). The port 5 may be provided in the fan casing 11 (FIG. 12) instead of being provided in the motor casing 11 (FIGS. 1, 3).

In operation, the nozzles 6 may be easily and quickly attached onto the air outlet 2 and/or the port 5 for selectively coupling to the air devices. The nozzle 6 attached to the air outlet 2 may be coupled to the selected air devices for supplying the pressurized air to inflate the air devices. The nozzle 6 attached to the port 5 may be coupled to the selected air devices for discharging or releasing the air from or out of the air devices. The cover 4 is preferably forced to block the holes 31 of the air inlet 3 (FIG. 10) when the port 5 is coupled to the air devices to discharge or release the air from the air devices, in order to facilitate the air suction or discharging of the air from the air devices.

Accordingly, the air compressor in accordance with the present invention includes an air compressor having one or more nozzles for selectively attached to the air compressor and to selectively couple the air compressor to various kinds of air devices for inflating the air devices. The nozzles may also be used for selectively discharging or releasing the air from the air devices.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An air compressor comprising:

a) a housing including:

i) an air outlet provided therein for coupling to an air device and for supplying an air to the air device, and ii) a port provided therein for coupling to the air device and for drawing the air out of the air device, b) a nozzle, and c) securing means for detachably securing said nozzle to either of said air outlet and said port of said housing.

2. The air compressor according to claim 1, wherein said air outlet includes a peripheral wall, a spider rib disposed in said peripheral wall for defining a plurality of apertures and for the air to flow out of said housing.

3. The air compressor according to claim 1, wherein said air outlet includes a peripheral wall, said securing means includes a pair of ears extended inward of said peripheral wall of said air outlet, and a pair of latches extended from said nozzle for engaging with said ears and for securing said nozzle to said air outlet.

4. The air compressor according to claim 3, wherein said air outlet includes a spider rib disposed in said peripheral wall and spaced from said ears for defining a channel between said ears and said spider rib and for receiving said latches of said nozzle.

5. The air compressor according to claim 1, wherein said port includes a peripheral wall, a spider rib disposed in said peripheral wall for defining a plurality of apertures and for the air to flow into said housing.

6. The air compressor according to claim 1, wherein said port includes a peripheral wall, said securing means includes a pair of ears extended inward of said peripheral wall of said port, and a pair of latches extended from said nozzle for engaging with said ears and for securing said nozzle to said port.

7. The air compressor according to claim 6, wherein said port includes a spider rib disposed in said peripheral wall and spaced from said ears for defining a channel between said ears and said spider rib and for receiving said latches of said nozzle.

8. The air compressor according to claim 1 further comprising an air inlet provided in said housing, and blocking means for selectively blocking said air inlet.

9. The air compressor according to claim 8, wherein said blocking means includes a cover for selectively engaged with said air inlet and for selectively blocking said air inlet.

10. The air compressor according to claim 9, wherein said air inlet includes a protrusion extended therefrom, said cover includes an orifice formed therein for receiving said protrusion of said air inlet and for blocking said air inlet.

11. The air compressor according to claim 9, wherein said air inlet includes at least one hole formed therein for inwardly flowing of the air into said housing, said cover is selectively engaged with said air inlet to selectively block said air inlet.

12. The air compressor according to claim 9, wherein said air inlet includes a peripheral wall provided therein, and limiting means for limiting a relative movement between said cover and said peripheral wall of said air inlet.

13. The air compressor according to claim 12, wherein said limiting means includes a peripheral flange extended radially outward of said peripheral wall of said air inlet, and a peripheral rib extended radially inward of said cover and engaged with said peripheral flange of said peripheral wall for limiting the relative movement between said cover and said peripheral wall of said air inlet.

* * * * *